United States Patent [19]

King

[11] Patent Number: 4,989,508

[45] Date of Patent: Feb. 5, 1991

[54] DEVICE FOR FACILITATING SUBLISTATIC PRINTING

[75] Inventor: James F. King, Winston-Salem, N.C.

[73] Assignee: XPRES Corporation, Winston-Salem, N.C.

[21] Appl. No.: 439,051

[22] Filed: Nov. 20, 1989

[51] Int. Cl.[5] ..... B41F 17/00

[52] U.S. Cl. ..... 101/35; 101/9; 101/488

[58] Field of Search ..... 101/33, 34, 35, 38.1, 101/39, 40, 9, 488; 156/212, 213, 215, 475, 494; 8/471–473

[56] References Cited

U.S. PATENT DOCUMENTS 4,078,031 3/1978 Bishop ..... 101/401.1

4,658,721 4/1987 Mathis ..... 101/32

*Primary Examiner*—Edgar S. Burr

*Assistant Examiner*—Ren Yan

[57] ABSTRACT

A device for facilitating sublistatic printing which includes an elastic member for covering an arcuate article surface to be imprinted in a stretched condition, holding a sublistatic transfer sheet against the article surface, and exerting a uniform pressure against the transfer sheet and article surface to achieve intimate contact therebetween; and an installing apparatus, one form of which includes a frame, band receiving means supported by the frame, two operating arms rotatably mounted to the frame, an article receiving member carried by the frame, and means associated with the arms to hold the elastic member. The arms are selectively movable from an elastic member receiving position to a transfer sheet receiving position to an article surface covering position. The elastic member is stretched prior to placement around the article surface to be imprinted and is provided with appropriate means to be releasably secured around the article. The article with the covering elastic member can be removed from the article receiving member, subjected to heat and sublistatically imprinted with the design or intelligence carried by the transfer sheet.

16 Claims, 5 Drawing Sheets

DEVICE FOR FACILITATING SUBLISTATIC PRINTING

BACKGROUND OF THE INVENTION

1. Field of the Invention

The present invention is for a device to facilitate sublistatic printing and includes an elastic member for holding a sublistatic transfer sheet against an article surface to be imprinted which is applied while in a stretched condition. The invention also includes means for stretching the elastic member and applying it to the article surface so that it holds the sublistatic transfer sheet in intimate contact against the article surface to be imprinted.

2. Background Information

Sublistatic printing is the technique of first placing a dye in the proper form and color on a vehicle, for example, a piece of paper conveniently referred to as a transfer sheet. The dye consists of special particles in an appropriate carrier such as water to form a viscous liquid which can be transferred to the transfer sheet by conventional printing equipment such as roller or offset printing machines. The dye can be in the form of a dry powder to be transferred to the transfer sheet using electrostatic principals such as those used in paper copiers. In all cases, however, the basic dye is manufactured from a material that sublimes; i.e., the material can convert from a solid particle to a gas without going through a liquid phase. Such a conversion is usually initiated by the application of heat. Thus positioning a transfer sheet against an article surface to be imprinted and applying heat will result in sublistatically printing that article surface. Detailed disclosures of the sublistatic printing process are set forth in U.S. Pat. Nos. 4,246,331 and 4,342,281, the contents of which are incorporated herein by reference.

Many materials have surface properties that cause them to expand upon the application of heat and then contract with cooling. During sublistatic printing, the heat forms microscopic tunnels or voids in the material surface, and the dye vapor moves into these voids by molecular dispersion. When the heat is removed and the surface cools, the microscopic tunnels or voids contract and close so that the trapped dye can be observed through the semi-transparent surface material which makes the dye coloring as permanent as the object surface.

There are many materials which are not deformable by heat or pressure and therefore not in their natural state susceptible to sublistatic printing. In those cases, the object surface must be coated with a material that does possess those desirable characteristics.

Many articles manufactured of materials not in their natural state susceptible to sublistatic printing are those upon which sublistatic printing is most desirable. Coffee cups, glasses, dishes, bowls and other articles of similar materials having arcuate surfaces are representative. Even though the forms in which they are cast are accurately machined, the soft clay used in their formation tends to slump and deform slightly before it can harden. Complete positive (intimate) contact under pressure between the transfer sheet and the surface to be imprinted is necessary for satisfactory sublistatic printing, and the surface irregularities of clay made products even when coated with a print inducing material make such contact difficult.

Applying the necessary heat to arcuate surfaces to be sublistatically imprinted has also been a difficult undertaking in the past. Heaters for this procedure have been usually of a sandwich construction generally consisting of a layer of fiberglass cloth, a reinforced silicone rubber sheet with a resistence heating element covered by another reinforced silicone sheet. This assembly is somewhat flexible but cannot be easily deformed locally to follow small rises and depressions in the surface to be imprinted and thereby achieve the intimate contact necessary.

Prior methods to apply circumferential or radial force to make the heater conform to surface irregularities include positioning wraps or webbing around the heater, transfer sheet and article and then tensioning the wraps or webbing to more evenly distribute the strap pressure to the irregularly shaped article surface.

Problems associated with these methods for conducting sublistatic printing on articles having arcuate surfaces generally are caused by trying to achieve an even pressure to all points of a curved surface by use of a strap or straps around the heater and transfer sheet to hold it against the article surface to be imprinted through pulling only from the ends of the strap or straps. Here the greatest radial pressure occurs near the pulling action - the strap ends. The remaining area covered by the strap receives less force from the pull. Therefore, radial pressure differentials exist at different points along the circumference of the article surface. In this situation, the sublistatic print will be darker in areas of high pressure and lighter in areas of low pressure.

The positioning of the transfer sheet on arcuate surfaces has also been a problem in the past in that the transfer sheet usually had to be taped to the surface prior to the application of a pressure applying device. This obviously takes a significant amount of time and effort and presents difficulties in achieving precise alignment during each installation.

OBJECTIVES AND SUMMARY OF THE INVENTION

It is an object of the present invention to provide a device for facilitating sublistatic printing by positioning sublistatic transfer sheets against the surfaces of articles to be imprinted in an expedient and efficient manner heretofore unachieved.

It is a further object of the present invention to provide an elastic member to exert a uniform pressure against a sublistatic transfer sheet positioned against an arcuate article surface to be imprinted and achieve intimate contact therebetween.

It is still another object of the present invention to provide an installation apparatus to position the elastic member and sublistatic transfer sheet against the article surface to be imprinted.

Yet still another object of the present invention is to provide a device for accomplishing efficient sublistatic printing on arcuate surfaces that is more economical, efficient, and productive than those heretofore known.

The present invention is directed to a device for facilitating sublistatic printing by positioning sublistatic transfer sheets intimately against the surfaces of articles to be imprinted which includes an elastic member, usually in the form of an elastic band, which envelopes or encircles the arcuate surface of an article to be imprinted to hold a sublistatic transfer sheet in place against that article surface and to exert a uniform perpendicular or radial pressure thereagainst. The elastic band is of sufficient stretched length to encircle the article and of sufficient diminished width when stretched to substantially cover the height of the article. A gripping or holding element may be affixed to each end of the band and may include features which connect to one another to secure the band after it encircles the article to be imprinted.

The invention includes an installation means or apparatus which in one form has a stationary frame and a workpiece receiving member mounted on the frame. Two arms are rotatably secured to the frame and carry means to hold each end of the band. The arms are movable from a first position where the elastic member is virtually untensioned to a second position where the member is fully stretched and then to a third position where the member has been wrapped around the article in a fully tensioned condition and releasably secured thereto.

The invention provides for maintaining a sublistatic transfer sheet intimately against the surface of the article to be imprinted so that a uniform perpendicular or radial pressure is exerted.

Other objectives and additional details of the invention will become more apparent upon consideration of the following detailed description of the invention taken in conjunction with the following drawings wherein like characters of reference designate like parts throughout the several views.

BRIEF DESCRIPTION OF THE DRAWINGS

For the purposes of illustrating the invention, presently preferred forms are illustrated. It is to be understood that the invention is not limited to the precise arrangements and relationships depicted in the drawings.

DETAILED DESCRIPTION OF THE INVENTION

Figure 1:
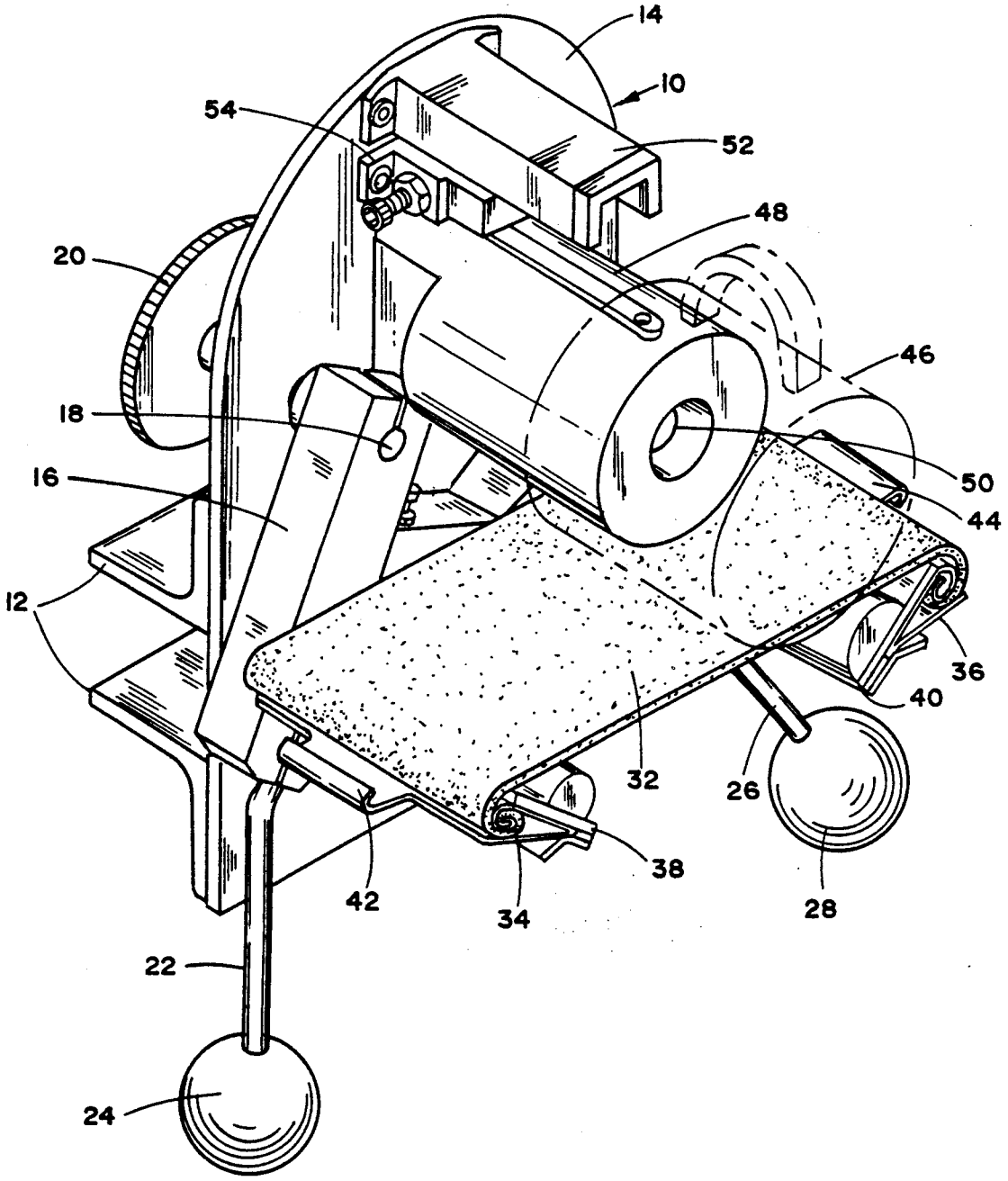
FIG. 1 is a perspective view of an elastic member and an installation apparatus formed in accordance with the present invention.

The present invention can be utilized to imprint intelligence and designs, e.g., words, patterns, numerals and the like on any article and is particularly suited to imprint on articles having arcuate surfaces such as tubular members or circular containers. Such articles can be of cylindrical, semicylindrical, hexagonal or octalobal shape and may be made of metal, glass, ceramic, plastic, paper, cardboard or any other material that will not melt at a temperature of approximately 200 degrees Centigrade or below. Imprinted containers may be used as drinking or food containers such as mugs, glasses, cups or bowls. An imprinted container may also be used as a vase, jar, coffee or teapot, pencil holder, bottle, mailbox, test tube, bowl, urn, thermos and flowerpot among other items. Examples of tubular structures to which the invention is applicable include mailing tubes, support bars for bicycles, and supporting structure for advertising displays. The field of application for the present invention is vast and practically unlimited.

If the material from which the article to be imprinted is made is not receptive to sublistatic dye, a polymer coating must be applied to the surface of the article prior to printing. Such polymer coating must be receptive to sublimation dyes, be asthetically acceptable (resemble the original glass or ceramic surface), and be inert; i.e., it must be safe to hold aqueous foodstuffs, withstand repeated contact with skin, and tolerate ingestion. Moreover, it should bond permanently to the article material. While the amount of coating applied is preferably 63 grams per square meter uniformly spread over the surface of the article, a coating of from 50 to 70 grams per square meter result in satisfactory printing.

In the present invention a transfer sheet is placed over the article to be imprinted. This sheet is generally made of paper which bears in mirror image the pattern or design to be transferred and formed from one or more sublimation dyes. A design is generally transferable from the transfer sheet to the article surface somewhere within the temperature range of 160 to 210 degrees Centigrade.

To prepare the transfer sheets for use in the invention, a printing ink is developed which typically contains ten percent (10%) dye, ten percent (10%) binder, and eighty percent (80%) solvent. The ink is used to print a base paper which has been provided with a release coating forming a design. The paper contains one or more dyes.

A significant feature of the present invention is relatively thin, elastic, preferably silicone rubber band, which is, in a relaxed condition, somewhat wider than the article to be imprinted. The ends or terminations of the band may be provided with rigid ends to facilitate gripping and stretching the band. The ends may carry cooperative latch clips as an integral part. Thus when the band is stretched and then positioned around the article to be imprinted, the latch clips engage and lock thereby holding the band in place. The elastic band is sufficiently thin that heat can be easily conducted through to the sublistatic transfer sheet underneath. Thus an economical source of heat such as natural or forced convection hot air can be used to heat the band from outside or the article from the other side or from the inside if it is a mug or glass. The thermal mass of the band is sufficiently small that the cool-down time after printing is greatly reduced. This is extremely important in a mass production operation.

The elastic band installed by the installation apparatus in the present invention differs from previously used devices in that latent energy is imparted to the band before it is placed in contact with the article. The band, in the stretched condition, is wrapped around the surface of the article without changing its latent energy (but with change in the latent force direction from tension to substantially radial or perpendicular to the article's surface at all points). The band is tensioned completely before wrapping begins, and this tension is held as the band is wrapped around the article so that there is insignificant circumferential pressure on the transfer sheet - only radial or forces perpendicular to the surface of the article are present. These perpendicular forces assure a consistent and intimate contact between the transfer sheet and the surface to be imprinted.

A number of advantages are immediately apparent from the present invention. These include:

(a) the transfer sheet does not have to be attached (taped or glued) to the article, (b) transfer paper placement is very accurate, (c) high contact pressure is achieved between the transfer sheet and the article, (d) uniform contact pressure is present between the transfer sheet and the article, (e) printing can extend to the top and bottom of an article and very near any appendage affixed thereto, (f) any irregularly shaped article can be accommodated, (g) a more even heat distribution can be achieved resulting in a very small heat sink and a very slight insulating capacity, (h) cycle time can be reduced since heat can be applied to the article and the band simultaneously, (i) a low heat storage capacity results in the cool-down time being much faster than normal, and (j) convection heat is more easily controlled than radiant heat.

The present invention may also be used to sublistatically print on cloth articles such as shirts, towels, jackets and the like. The article is positioned on a supporting arcuate surface, and a transfer sheet is placed at the desired shirt location. The elastic member is pulled across the transfer sheet so that it engages the shirt surface material, and a heated airflow is then directed against the elastic member or from below the article.

Thus the elastic member of the present invention may be used effectively to print on arcuate surfaces without limitation and may be used to print on other surfaces with appropriate cooperating equipment. Such printing may be done manually or by using a variety of installing devices such as that illustrated and discussed hereafter.

Referring now to the drawings, FIG. 1 shows generally an installation apparatus 10 which, in this illustrative embodiment, is a machine securable to a table or desktop by clamping means 12. Apparatus 10 includes a frame 14 to which is rotatably mounted two arms 16,17 secured to frame 14 by pins 18,19 or other suitable means. Arms 16,17 pivot on shafts 18,19 which pass through frame 14 and are connected at the back of the apparatus to synchronizing gears 20,30 best shown in FIG. 5. Arms 16,17 have handles 22,26 and gripping knobs 24,28 respectively.

Two stop links 56,58 are provided to locate arms 16,17 in the two lower positions described below. Elastic band 32 has band terminations 34,36 which rest in support plates 38,40 affixed to arms 16,17 respectively. Terminations 34,36 may be provided with rigid ends 34',36' that have mating interlocking latch clips 42,44.

Mug 46 (depicted by phantom lines in FIG. 1) is received by workpiece receiving member 48 which is connected to frame 14 by bolt 50. Workpiece receiving member 48 has a shape to accommodate the configuration of the article to be imprinted. For a cylindrical article, workpiece receiving member 48 will be cylindrical as it is in FIG. 1 to receive mug 46. The handle 47 of mug 46 is guided into an uppermost position by slotted member guide 52. When installed, the mug inside bottom rests against the end of workpiece receiving member 48.

Figure 2:
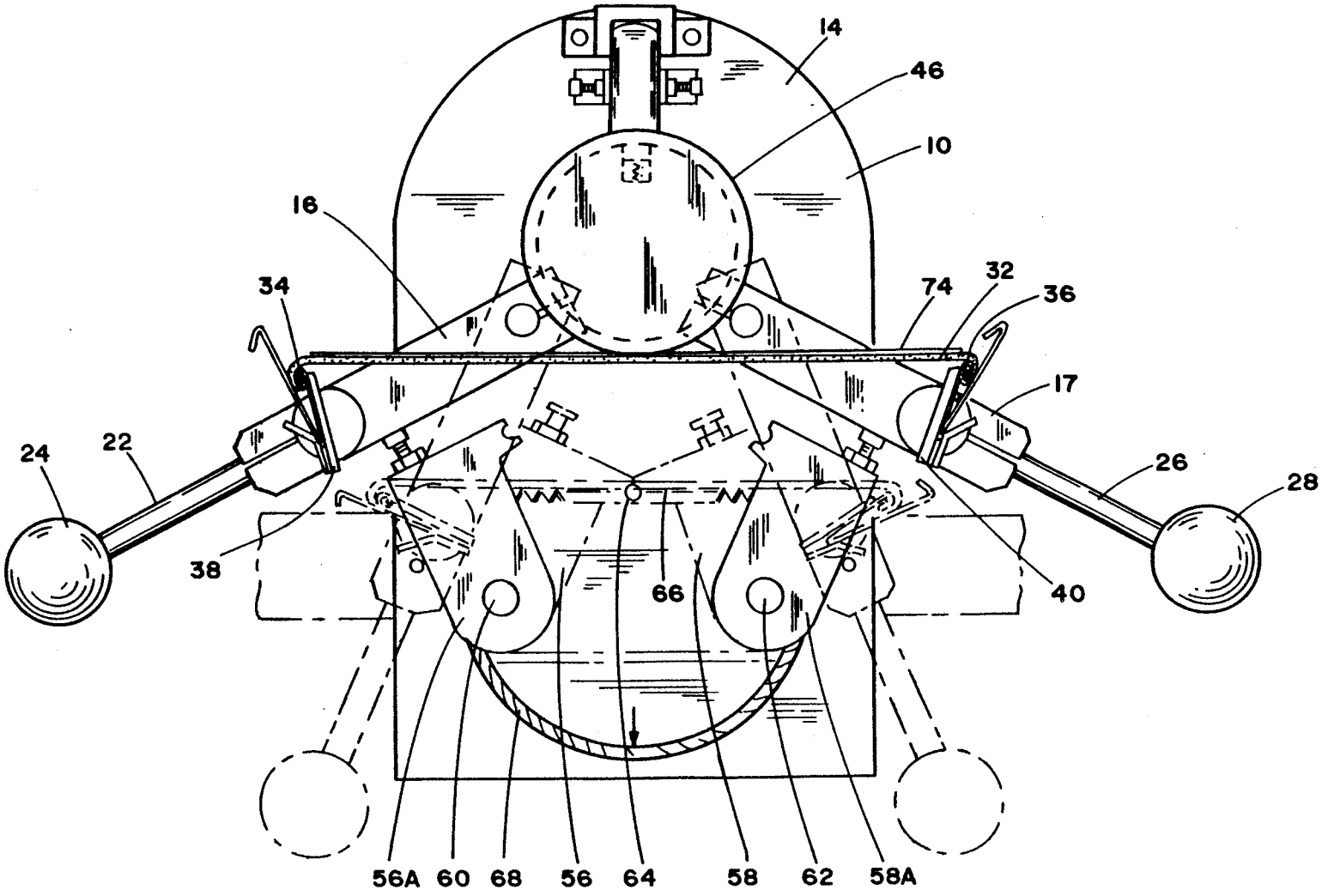
FIG. 2 is a front elevational view of the elastic member and installation apparatus shown in FIG. 1.

FIG. 2 illustrates two of the three operating positions of arms 16,17. The first, or band loading position, is with both arms 16,17 swung down to engage stop links 56,58 which are pivoted about bolts 60,62 respectively. Stop links 56,58 are pulled together against centering stop pin 64 by the action of spring 66 and swing outwardly together by downward pressure exerted on rope 68 made of nylon or other suitable material.

When arms 16,17 are moved against stop links 56,58, they remain in this position under the influence of gravity. With arms 16,17 in this position, elastic band 32 is installed in a nearly relaxed condition, yet its elasticity causes termination ends 34',36' to engage support plates 38,40 and remain associated therewith in a secured position.

Arms 16,17 are then rotated upwardly, and rope 68 is urged downwardly to rotate stop links 56,58 to positions 56A,58A. Arms 16,17 are then lowered slightly until they engage adjustable stops 70,72. Here in a second position, elastic band 32 is stretched to the desired elongation and lies just beneath installed mug 46.

While stretched band 32 is held in this second position, a transfer sheet 74 carrying sublistatic ink in a predisposed design is positioned between the mug 46 and the horizontally positioned stretched band 32. The transfer sheet 74 is easily and accurately positioned by hand on the surface of band 32, however, it may be installed automatically by suitable equipment if that is desirable.

Figure 3:
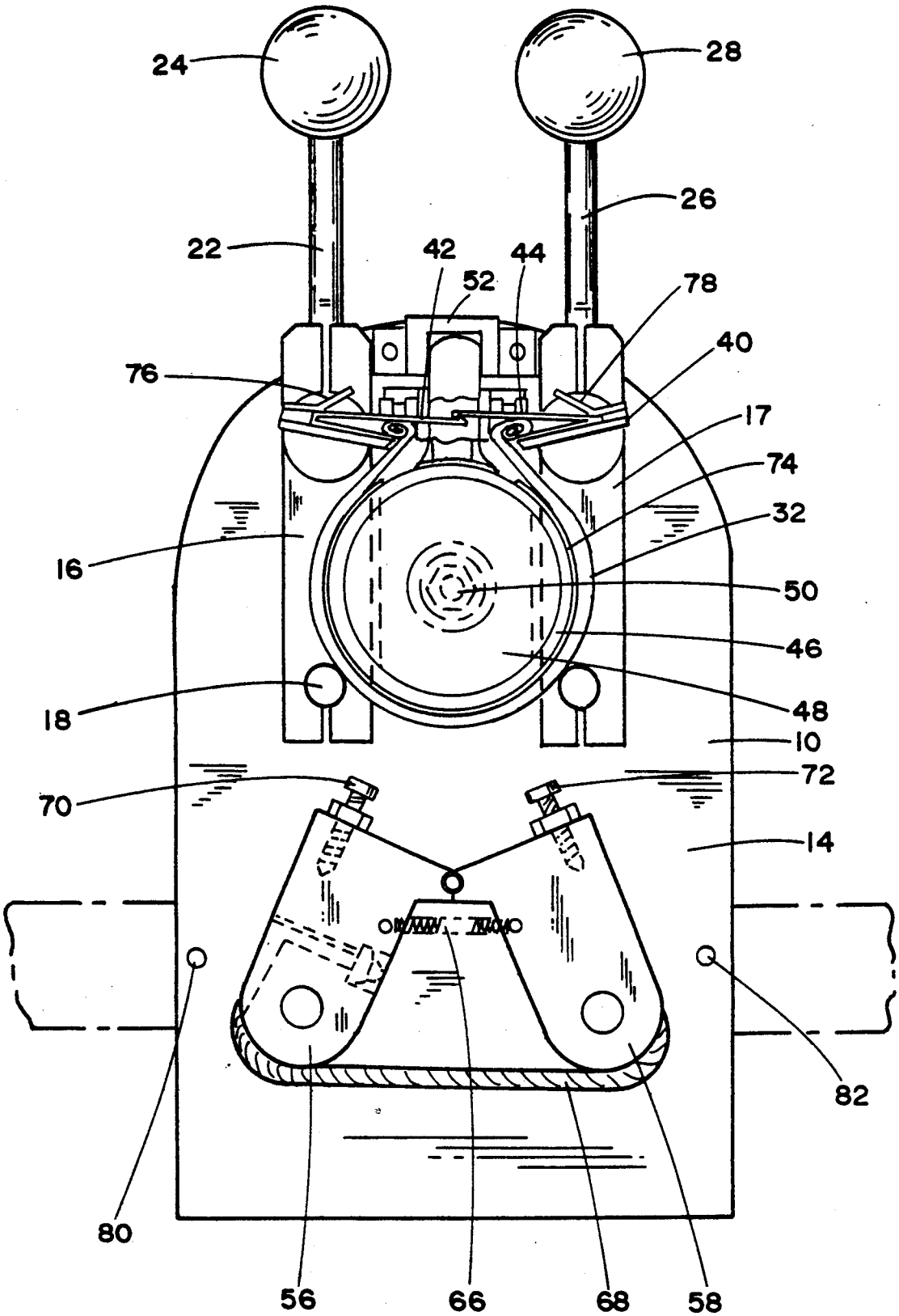
FIG. 3 is a front elevational view of the elastic member and the installation apparatus as shown in FIG. 1 further illustrating the stretched member being wrapped around a mug.

Arms 16,17 are then moved again upwardly to a third position depicted in FIG. 3. The commencement of the upward movement releases pressure on stop links 56,58, and they swing inwardly to centering stop pin 64. Further upward movement locks transfer sheet 74 between the stretched band 32 and mug 46. When arms 16,17 are substantially horizontal, band 32 is fully stretched, and its encircling of mug 32 has commenced. Further upward movement of arms 16,17 will cause band 32 in its stretched condition to encircle the remainder of mug 42 and intimately position transfer sheet 74 thereagainst until arms 16,17 reach the substantially vertical position shown in FIG. 3. Here the terminations 34,36 extend through the mug handle and the end latch clips 42,44 engage. As these latch clips 42,44 contact each other, the elasticity of band 32 allows latch clip 44 to move upwardly off support plate 40 until latch clips 42,44 are releasably secured to each other.

After the clips 42,44 are latched; arms 16,17 are separated, support plates 38,40 are disengaged from clips 42,44, and elastic band 32 exerts a torque on clips 42,44 resisted by plate lips 76,78. As support plates 38,40 are parted from clips 42,44, the thinned edges of clips 42,44 slide up the tapered lips 76,78 to allow clips 42,44 to move to the surface of mug 46 under handle 47. As clips 42,44 are rotated about the inner edges of support plates 38,40 and as the clips slide up plate lips 76,78, studs 80,82 disengage from termination slots 84,86 and the clips 42,44 slide free of support plates 38,40. Arms 16,17 are then returned to their lowest positions to free mug 46 and its carried stretched band 32 and secured transfer sheet 74. Mug 46 with the band and transfer sheet can then be removed from workpiece receiving member 48. Stop pins 80,82 that limit the outward movement of stop links 56,58 are shown in FIG. 3.

Figure 4:
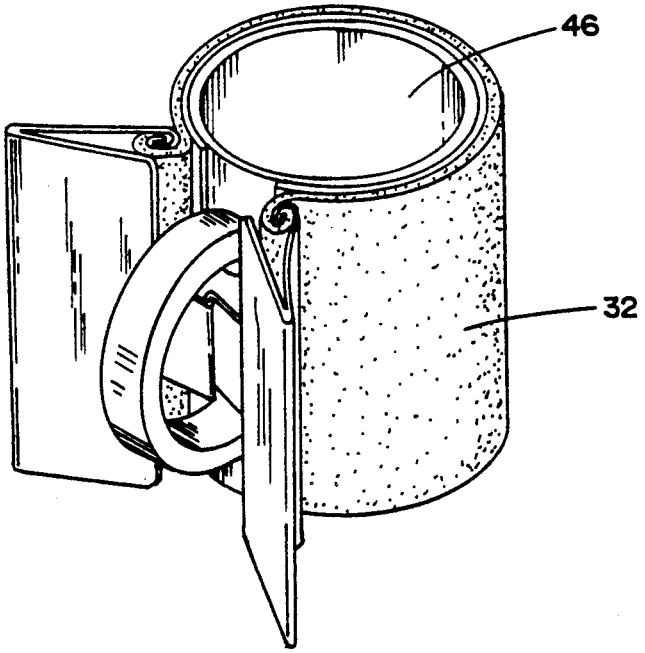
FIG. 4 is a perspective view of the elastic member installed around a mug.

FIG. 4 shows mug 46 removed from the installion apparatus with band 32 and transfer sheet 74 encircling it. Mug 46 is now ready for positioning in a heating device to initiate and carry out sublistatic printing.

Figure 5:
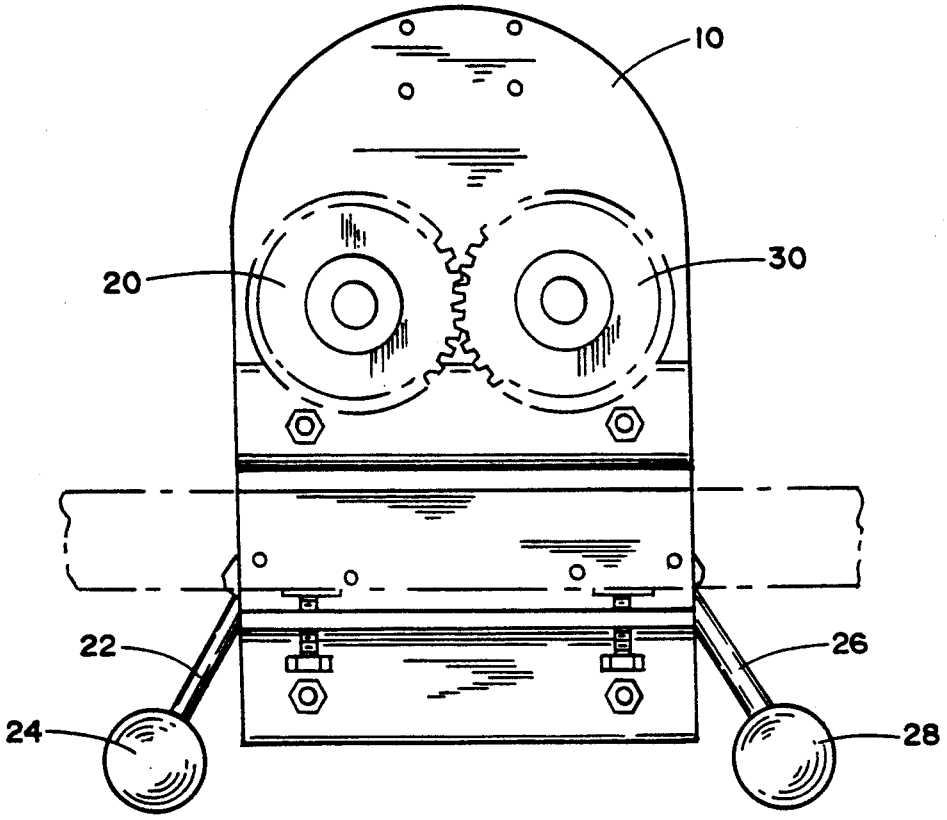
FIG. 5 is a rear elevational view of the installation apparatus as shown in FIG. 1.

FIG. 5 is a rear elevational view of apparatus 10 showing base plate 14 which supports pins 18,19 fixedly secured to synchronizing gears 20,30 respectively that positively engage and rotate with each other when arms 16,18 are displaced. Clamping element 12 permits apparatus 10 to be fastened by the adjustment of clamp screws 75,77.

Figure 6:
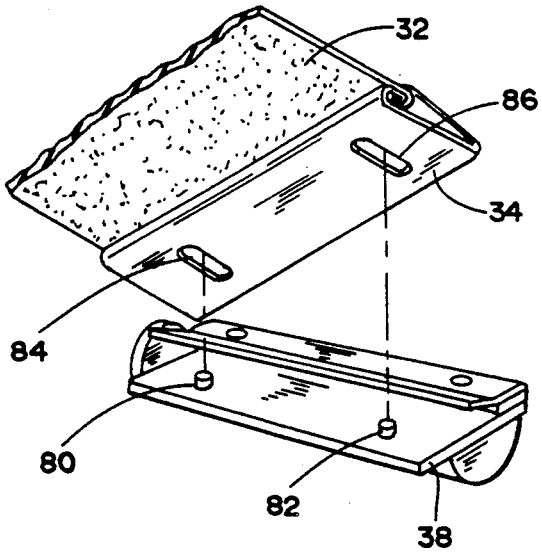
FIG. 6 is a perspective fragmentary view showing one end of the elastic member as shown in FIG. 1 and the attachment means of the installation apparatus.

FIG. 6 shows one end of elastic band 32. A support plate 38 is shown detached from apparatus 10 and has two studs 80,82 on its upper surface which engage slots 84,86 and termination rigid end 34'.

Figure 7:
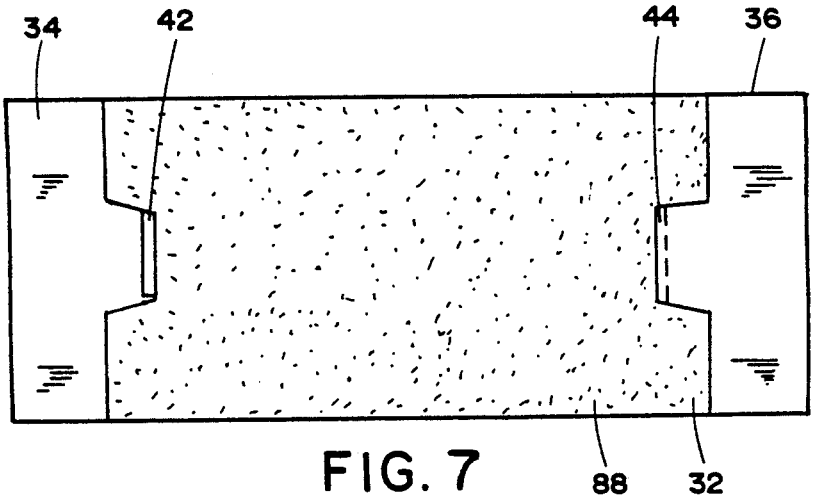
FIG. 7 is a plan view of the elastic member as shown in FIG. 1.

Band 32, shown extended in FIG. 7, has an elastic portion 88 preferably formed usually of rubber and more preferably of silicone rubber. The silicone rubber preferably has a durometer of Shore A50, a tensile strength of about 1,200 psi, an elongation potential of around 600% and a thickness of approximately 0.062 inches. At the desired stretch for installation, the tension in band 32 is approximately 25 pounds. The radial pressure around mug 46 exerted by the installed band is approximately 4.4 psi. The elastic portion 88 is relatively thin so as not to unduly interfere with the requisite heat transfer to conduct sublistatic printing. The rubber formed portion 88 should be able to withstand temperatures required for sublistatic printing which range up to at least 210 degrees Centigrade. At each end of elastic portion 88 are the terminations 34,36 having rigid ends 34',36' with interlocking latch clips 42,44 which have been previously described. Rigid ends 34',36' are usually fabricated from a metal, and aluminum segments 0.032 inches thick have been found quite suitable. Ends 34',36' may be connected to the ends of elastic portion 88 by crimping or other suitable means.

Elastic band 46 exerts a uniform pressure around sheet 74 and mug 46 to ensure adequate printing in areas of imperfection such as depressions, and uneven or raised surfaces. The parameters of rubber elastic portion 88 may be varied depending on the flexibility of the portion 88 and the irregularity of the surface to be imprinted. The critical requirement for achieving good sublistatic print transfer is uniform and intimate force-applied surface contact between the transfer sheet 74 and the surface to be imprinted. The more flexible portion 88, the closer and tighter is the contact between transfer sheet 74 and the article surface to be imprinted.

Figure 8:
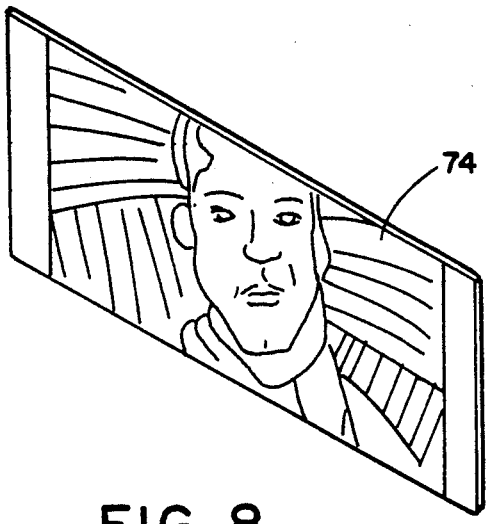
FIG. 8 is a perspective view of a sublistatic transfer sheet containing a design.
Figure 9:
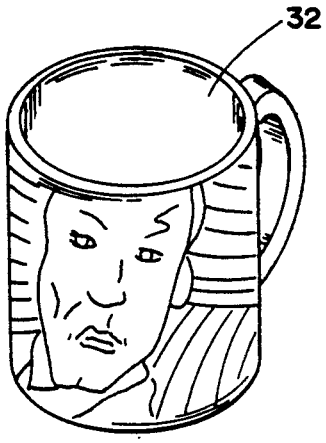
FIG. 9 is a perspective view of a mug which has been printed with the design carried by the transfer sheet shown in FIG. 8.

A transfer sheet 74 held on a mug 46 by band 32 is shown in FIG. 4. The assembly is heated in a suitable heating device at a temperature of from 190 to around 210 degrees Centigrade for two to three minutes in order to achieve sublistatic printing of the design 20 (FIG. 8) on mug 46. A sublistatically printed mug is depicted in FIG. 9.

While there have been disclosed embodiments of an elastic member and an installation apparatus suitable to facilitate sublistatic printing on articles having arcuate surfaces, the present invention is not to be limited by the embodiments shown. The specification and claims set forth herein are by way of illustration and not limitation, and various modifications and changes may be made without departing from the spirit and scope of the present invention.

What is claimed is:

1. A device for facilitating sublistatic printing of a workpiece having an arcuate surface including a workpiece receiving member and means to position sublistatic transfer sheet against the surface of said workpiece held by said workpiece receiving member, said means including an elastic band having opposite ends, said band having band termination means at each of said opposite ends, said termination means having interlocking latch clip means to apply said elastic band means over said transfer sheet to provide a substantially uniform intimate radial pressure against said transfer sheet and said workpiece, said means to apply including means to hold said termination means, and first elastically stretch said band by moving said termination means apart and subsequently apply said band, while in said stretched condition, to said transfer sheet by moving said termination means around said workpiece receiving member and engaging said interlocking latch clips so that said elastic band holds said transfer sheet against said workpiece with a substantially uniform pressure.

2. The device as claimed in claim 1 wherein said elastic band is formed of rubber.

3. The device as claimed in claim 1 wherein said elastic band is formed of silicone rubber.

4. The device as claimed in claim 3 wherein said elastic band has a durometer of Shore A50.

5. The device as claimed in claim 4 wherein said elastic band has a tensile strength of at least 500 psi.

6. The device as claimed in claim 5 wherein said elastic band has a thickness of at least 0.05 in..

7. The device as claimed in claim 6 wherein said elastic band has an elongation potential of at least 25%.

8. The device as claimed in claim 7 wherein said elastic band exerts a substantially perpendicular pressure of at least 1 psi.

9. The device as claimed in claim 1 wherein said means to apply includes a frame, and two operating arms each rotatably mounted to said frame.

10. The device as claimed in claim 9 wherein said elastic band is formed of rubber.

11. The device as claimed in claim 9 wherein said elastic band is formed of silicone rubber.

12. The device as claimed in claim 11 wherein said elastic band has a durometer of Shore A50.

13. The device as claimed in claim 12 wherein said elastic band has a tensile strength of at least 500 psi.

14. The device as claimed in claim 13 wherein said elastic band has a thickness of at least 0.05 in..

15. The device as claimed in claim 14 wherein said elastic band has an elongation potential of at least 25%.

16. The device as claimed in claim 15 wherein said elastic band exerts a radial pressure of at least 1 psi on the article surface.

* * * * *